US007138573B2

(12) United States Patent
Facq

(10) Patent No.: US 7,138,573 B2
(45) Date of Patent: Nov. 21, 2006

(54) DUAL SINGLE REED MODULE, PARTICULARLY FOR INSTRUMENTS OF THE ACCORDION TYPE

(76) Inventor: Paul Facq, 4 Place de l'Eglise, F-87290 Rancon (FR)

( * ) Notice: Subject to any disclaimer, the term of this patent is extended or adjusted under 35 U.S.C. 154(b) by 0 days.

(21) Appl. No.: 10/808,241

(22) Filed: Mar. 25, 2004

(65) Prior Publication Data

US 2004/0244561 A1 Dec. 9, 2004

(51) Int. Cl.
*G10D 9/02* (2006.01)

(52) U.S. Cl. ..... 84/383 A

(58) Field of Classification Search ..... 84/350, 84/383 A, 375, 363, 360, 361
See application file for complete search history.

(56) References Cited

U.S. PATENT DOCUMENTS 4,142,438 A * 3/1979 Ehler ..... 84/360

2002/0000154 A1 1/2002 Antaki

* cited by examiner

*Primary Examiner*—Kimberly Lockett
(74) *Attorney, Agent, or Firm*—Young & Thompson

(57) ABSTRACT

The object of the invention is a single dual reed module, particularly for an instrument of the accordion type using two directions of air flow, characterized in that it comprises, for each note, a single fixed tongue carrier (32) with a window (34) and a tongue (36) connected to this tongue carrier and comprising at least one tongue (42) disposed in line with this window, as well as at least one associated movable element (44), disposed laterally relative to said tongue and adapted to take a first position for a first direction of air flow by providing an interstice between this movable element and the edge of the tongue such that this blade vibrates to emit said note in this first direction of air flow, and a second position symmetrical to the first position relative to the plane of the tongue for the second direction of air flow, by also providing an interstice such that the tongue vibrates to emit the same note in this second direction of air flow.

12 Claims, 6 Drawing Sheets

DUAL SINGLE REED MODULE, PARTICULARLY FOR INSTRUMENTS OF THE ACCORDION TYPE

BACKGROUND OF THE INVENTION

The present invention relates to a dual single reed module, particularly provided to be disposed in a wind instrument that operates in both directions of the air, such as an accordion.

The accordion is the instrument selected to give all the explanations and to provide all the information necessary to the operation, but it is to be intended that the reed according to the present invention could be mounted in all cases where a tongue must vibrate, wherein the air moves perpendicularly from above or below relative to the plane of the tongue. It is thus that in what follows of the description, we will speak of two directions of the air.

For the production of accordions, a large number of pieces is necessary.

Thus, an accordion comprises two casings connected by a bellows forming a chamber. In each of these casings, within the enclosure, there are arranged sound boards provided with openings, and mechanisms for opening and closing these openings. These sound boards generally carry several reed blocks which are supports for numerous modules also called "reed plates" in the field of the production of accordions. These modules are disposed facing the openings to be traversed or not by the air flows generated by the bellows, as a function of the actuated keys.

Each module is thus the element for the production of the sound and comprises a blade carrier. A module comprises two windows and in each one a blade fixed by one of its ends provided with a heel on said blade carrier. The blade is prolonged by its free end also called a tongue in this window.

This tongue, vibrated by the air flow passing through the window, permits producing sound.

As a function of the nature, the thickness, the dimensions of length/width and of the cutout of the tongue, there are obtained sounds corresponding to the desired notes.

In known accordions, each module comprises, for the same note, two windows and two blades for each of the two possible directions of the air. One of the blades is riveted on one of the surfaces of the module facing the first window and the other blade is riveted on the other surface facing the other window.

Each window is provided, on the surface of the module opposite that which carries the blade, with a valve, generally made of a flexible material, more particularly of leather.

Thus, for one direction of the air, the corresponding tongue is vibrated and produces the note, whilst the valve on the other window limits the escape of air through the other window.

For the other direction of the air, it is the reverse.

So as to give to this valve the desired stiffness, there is often added a resilient return element, such as a thin and narrow spring tongue.

This causes disturbance, because this arrangement with a valve is not favorable to propagation of the sound wave emitted by the vibrating tongue.

It will also be understood that for a given note, there are required a module with a blade carrier, at least two blades, two rivets, two valves, and often two resilient return elements, namely 9 pieces, which equals for even the smallest accordion a very large number of elements.

In addition to the number, it is necessary to adjust each of the contributing elements. The clearance between the tongue and the window, the curvature of the tongue to create an interstice, the resilient return element of the valve, must be made symmetrical in order to produce the same note.

It is thus known that for so-called "musette" accordions, the musicians want to have the exact note but also to have at least one note very slightly above or below it, which is to say three modules for a note with six tongues. In certain cases, there are required up to four tongues for a same note, namely eight tongues for the two directions of the air. These accordions are provided with more than a thousand tongues.

The result is the total number of pieces of several thousands for certain instruments, counting the securement means for the blade carriers and of the modules, the key mechanisms, the securement means for the reed blocks, the sound boards, in particular.

This renders long and very difficult the production and above all complicates the tuning which remains reserved for specialists who are fewer and fewer in number. The cost is very high and the delicacy increases proportionally to the complexity.

Another very great drawback is the weight that arises from the increase in the number of pieces.

The weight of an accordion, 15 kilograms for the heaviest but ordinarily 9 kilograms, prevents youngsters from carrying the instrument. They must play seated. Holding it is made difficult for all musicians and this all the more for small people.

Maintenance is complicated and the instrument is delicate because the closures for the valves in particular, of leather, are subjected to attack by mildew in the presence of moisture. The mechanical characteristics also vary greatly as a function of the temperature and premature aging takes place unless substantial maintenance is carried out by specialists who are also becoming scarce. Accessibility remains difficult. The costs are high and the delays are great.

All this leads to stagnation in the development of this instrument, even if certain countries have large production.

It would thus be useful to have modules whose tongue can vibrate in both directions of the air because the number of tongues necessary would be divided in two. Moreover, the windows and the associated pieces such as valves being omitted because they become unneeded, the weight and the size would be reduced accordingly.

Moreover, omitting valves would permit better sound propagation.

Tests have been conducted for a number of years without success.

There can be cited prior art such as French patent No. 1,350,800, in which the inventor states a goal without indicating any way to reach it.

German patent No. 34 13 382 discloses a reed that can operate in both directions, the tongue remaining in the same position and a frame being moved on opposite sides of the plane of the tongue to give a certain dissymmetry.

Such an arrangement is unsatisfactory because of the inertia of the frame and by the parasitic noises generated by such movements of large size pieces.

SUMMARY OF THE INVENTION

The object of the present invention is to provide a musical module with a dual single reed, which is to say which operates in the two directions of the air. This module as set forth in the description which follows, can be produced industrially. This module is free from the drawbacks connected with manufacture, decreases considerably the number of pieces because in addition to the fact of dividing by two the number of tongues, the valves are omitted as well as the associated elements for securement and/or resilient return.

These modules permit the production of simpler instruments, more reliable, without at the same time sacrificing the musical quality which remains at least as good or even better because the freed space can be profitably used to increase the outlet openings for the sound outside the instrument. It happens that reproducibility is also improved, by limiting the operations associated with the know-how of the producer in addition to the industrial production considerations.

BRIEF DESCRIPTION OF THE DRAWINGS

The invention will now be described in detail with respect to a particular and preferred embodiment, which is not limiting, with respect to the accompanying drawings, which show in the various figures.

DESCRIPTION OF THE PREFERRED EMBODIMENTS

Figure 1:
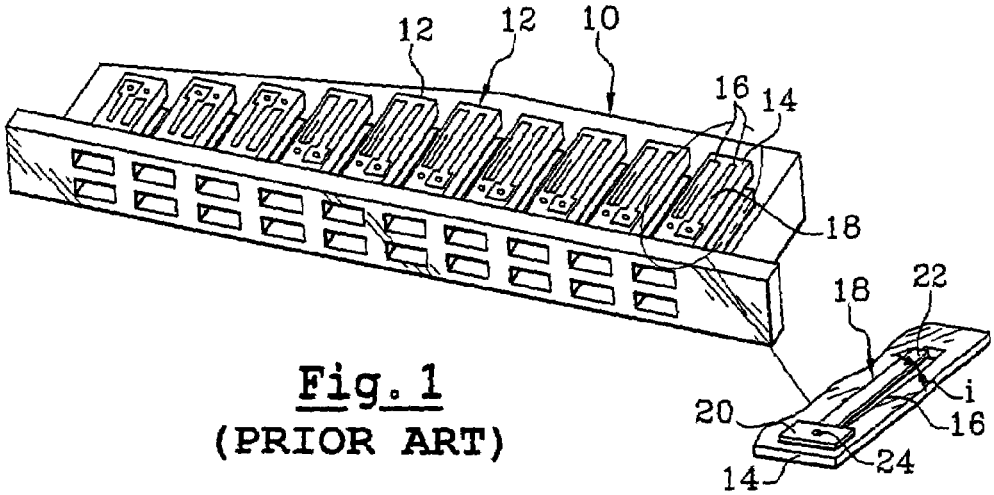
Fig. 1 (PRIOR ART)
FIG. 1, a view of the reed block of the prior art carrying modules of the prior art, FIG. 2, a perspective view of a module according to the present invention, FIGS. 3A to 3D, transverse cross-sectional views on the section lines indicated in FIG. 2, FIG. 3E, a cross-sectional view on the same line D—D of FIG. 3D but with the opposite direction of the air, FIGS. 4A and 4B, perspective and plan views of the arrangement of the tongue with respect to the window provided in the module of the invention, FIGS. 5A to 5D, various views of embodiment of the flaps, FIG. 6, a cross-sectional view of a modified embodiment in which the tongue is in the plane of the heel with securement of the axles of the flaps overlying, FIG. 7, a view of a second modification of the embodiment of the axles of the flaps, and FIG. 8, a perspective view of a modified facilitated form of production shown with a mounted flap and a flap before mounting.

In FIG. 1, there is shown a reed block 10 of the prior art supporting several modules 12. Each module comprises a blade carrier 14 with two windows 16 provided through said blade carrier, a blade 18 fixed on each surface of the blade carrier, facing the corresponding window, each blade having a heel 20 and a tongue 22 adapted to vibrate freely within the associated window 16.

Each heel 20 is fixed on the blade carrier preferably by a rivet 24 which has the advantage of not unscrewing under the influence of vibrations.

Between the tongue and the window, about each periphery, is provided an opening of very small dimensions and each tongue is curved outwardly of the blade carrier, so as to provide an interstice i between the plane of said tongue and the plane of the blade carrier.

Thus when the air flow is directed toward the tongue, it is deflected about the edges of the tongue and passes through this interstice. It is during the forced passage of this flow through the interstice, that the tongue is caused to vibrate, in a substantially instantaneous manner for tongues of low inertia and in several tenths of a second for the largest tongues corresponding to low notes.

The dimensions of the blade carrier are 18 to 50 mm in length by 18 to 22 mm width and 2 to 5 mm thickness, to give an order of magnitude. The tongues have several tenths of a millimeter of thickness.

In the drawings, the scales are not accurate, to permit better reading.

In the case of the prior art, if the air flow is in the opposite direction, the tongue bends and moves away from the blade carrier without vibrating. This is the reason for the presence of valves, each carrying a resilient return element, these valves preventing the untimely loss of air as explained above.

Thus, it will be seen that it is absolutely necessary to arrange the assembly of the module with a suitable dissymmetry to start vibration, which explains the impossibility of providing a dual single reed with the design of the prior art.

Figure 2:
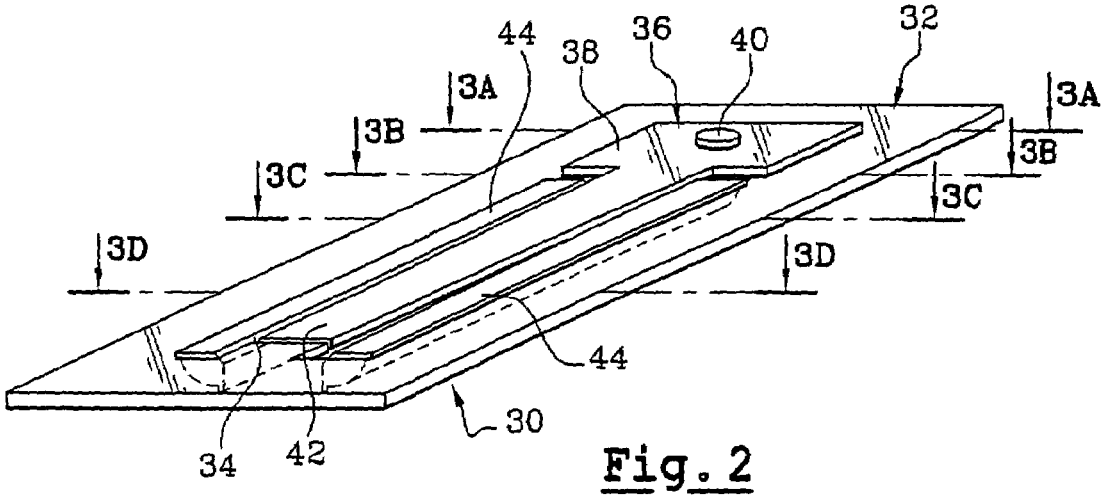

Module 30 according to the present invention is shown schematically in FIG. 2.

This module 30 comprises a blade carrier 32 with a window 34. A blade 36 comprising a heel 38 is fixed with a rivet 40 on this blade carrier as well as a tongue 42 which is free to vibrate in the window 34.

On opposite sides of the longitudinal edges of the tongue 42, there are provided movable flaps 44.

These flaps are inscribed within the window 34.

The description which follows is given without particular regard to the sequence of FIGS. 3A to 3E and 4A, 4B.

In the present embodiment, the heel 38 is disposed in superposition on the blade carrier. The securement can be perfectly rigid, which is the case with the rivet 40.

Figure 3A:
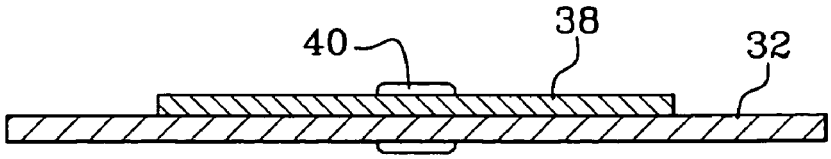
Figure 3B:
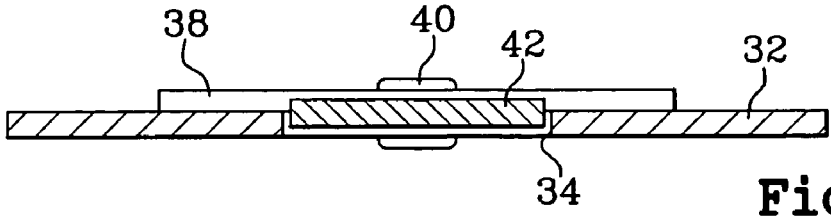
Figure 3C:
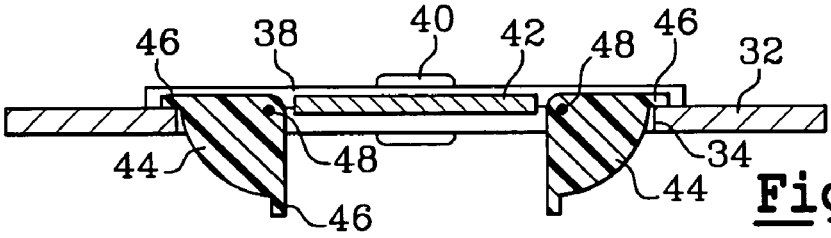

This is shown in FIG. 3A, which is a cross-section on the line 3A—3A.

Moving along the longitudinal axis of the blade, we come to the plane of cross-sectional line 3B—3B.

At this level, there will be noted the presence of the window 34 with the tongue which is located in this window.

For this embodiment, the tongue is deformed so as to be disposed with part of its thickness in the window. The heel is thus above the plane of the window of necessity and the tongue must be located at least in part within the thickness of the tongue carrier.

According to the present invention, in contrast to the prior art, the plane of the tongue should be kept perfectly integrated such that this tongue will be perfectly symmetrical. There is no longer the need for an interstice by permanent curved deformation of the tongue above the plane of the module, outwardly. This can be seen from the different successive cross-sections. Along the cross-sectional line 3C—3C, there will be seen the presence of flaps 44. These flaps are present in the form of portions of a figure of revolution. In this embodiment, it is a cylindrical but there could also be envisaged a cone or a more complicated piece. In the event, it is a matter substantially of a quarter of a cylinder, so that the surfaces of each portion of the cylinder will be perpendicular to the plane of the tongue at rest.

Two ribs 46 extend along all the length of each flap, in the plane of each surface of the dihedral. These ribs are arranged to come respectively into bearing against the corresponding edge of the window 34, from above and below.

These flaps are movable in rotation relative to the blade carrier about an axle 48 parallel to the longitudinal edge of the tongue.

This axle must necessarily be disposed in the medial plane of the tongue, to ensure symmetry.

It will be noted that the angular sector is about a quarter of a cylinder, because it is necessary to include materially the axle 48, which coincides with the geometric axis of the curved portion, except for displacing the axis of rotation outside the section of the flap.

Referring to the cross-sectional plane on line 3D—3D, the elements are identical to those of the preceding cross-section, except the edge of the cylindrical portion along which is provided a bevel 50. This bevel preferably is more and more pronounced the farther one proceeds from the heel toward the end of the tongue.

This permits generating an interstice of variable dimensions between each of the flaps and the tongue, in the plane of the tongue. This bevel is shown flat but could be hollow or of a more complex form without modifying the present invention, given that it is necessary to create an interstice, between each of the flaps and the tongue.

It will also be noted that this interstice, of variable dimensions along the tongue, is unsymmetrical and permits the tongue to vibrate, although the neutral surface of this tongue will be flat.

In this position, the upper rib 46 bears on the upper surface of the blade carrier or on an attached abutment.

Figure 3D:
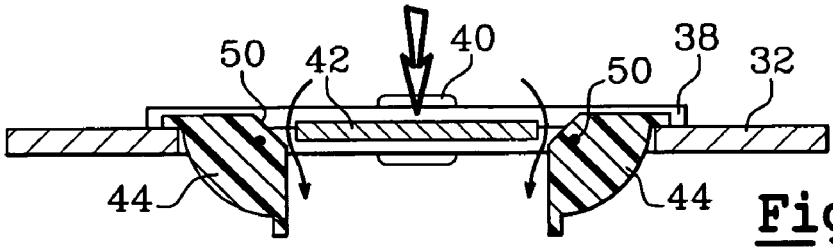

The direction of air flow and the passages through the interstices are shown in this FIG. 3D.

The interstice of variable dimensions, being in this embodiment of greater dimensions in line with the end of the tongue, gives rise to a more effective vibration of said tongue.

Figure 4A:
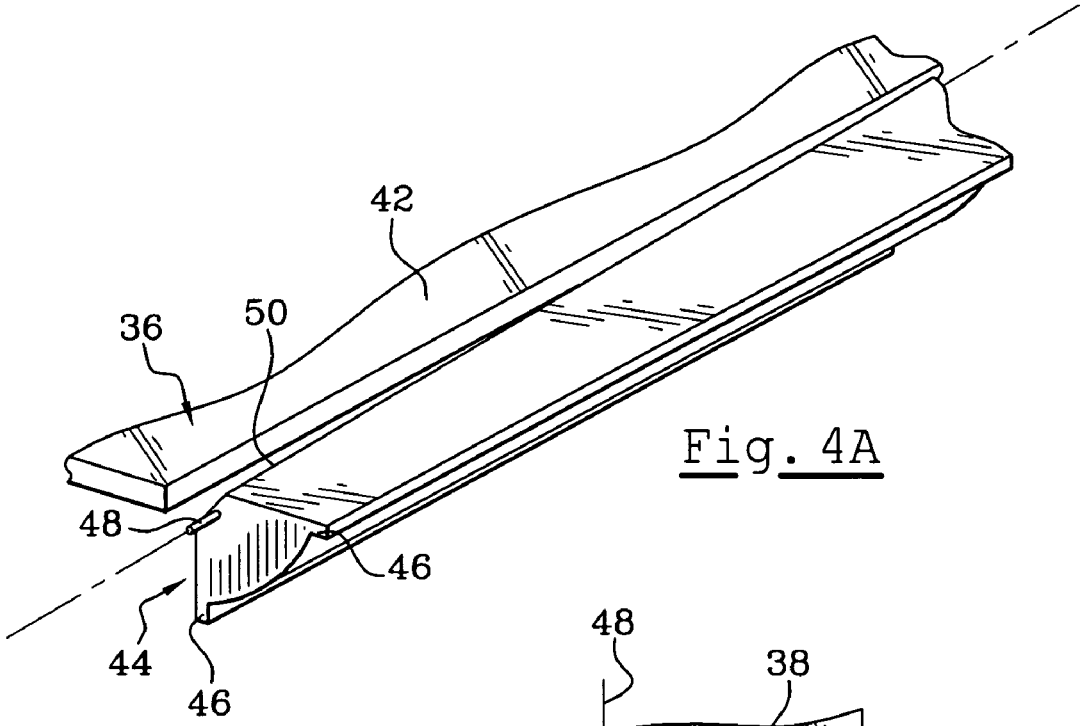
Figure 4B:
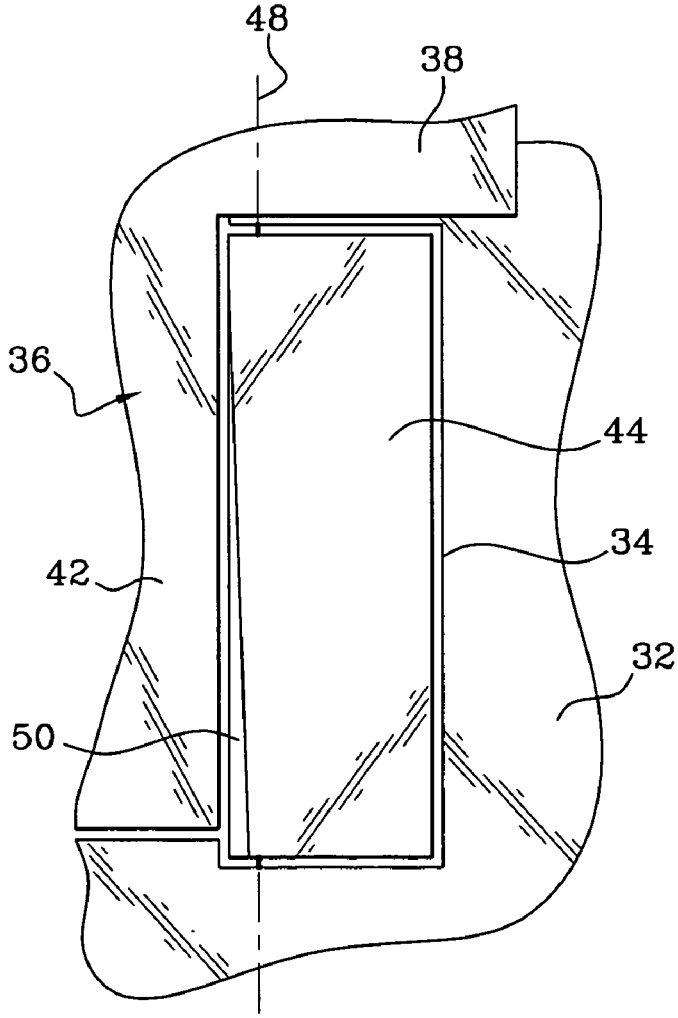

In FIGS. 4A and 4B, this interstice is clearly shown.

FIGS. 3A to 3D show the position of the different members for one direction of air flow.

Figure 3E:
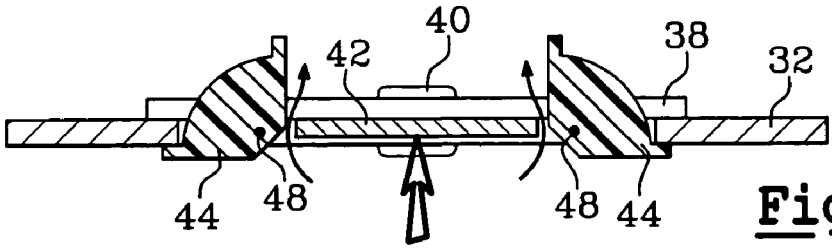

It will be seen when the air flow direction is opposite, FIG. 3E, that the symmetry of operation is still observed relative to the tongue.

In this position, the lower rib 46 bears against the lower surface of the blade carrier. Each flap has pivoted about its axle 48. Thus, the differential pressure of the opposite direction has rotated the flaps because the ribs constitute drive means and simultaneously end of path abutments.

The interstices are arranged symmetrically and the tongue can vibrate in the same way as before, but in the other direction of the air.

Such flaps, even produced of plastic material, can give rise to parasitic noises during pivoting, especially when the movement is abrupt. Even if such parasitic noises are not perceptible to untrained ears, it is necessary to be able to cure this imperfection.

Figure 5A:
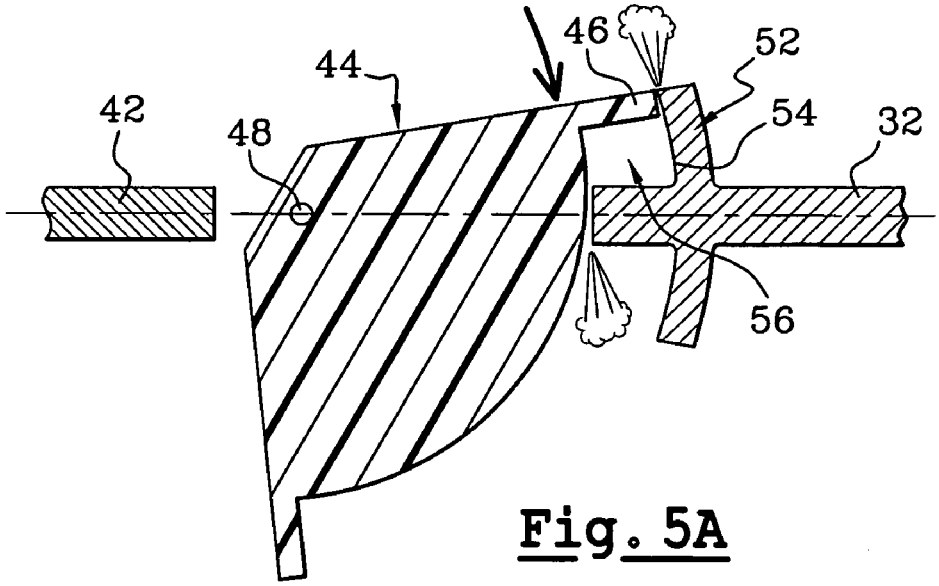
Figure 5B:
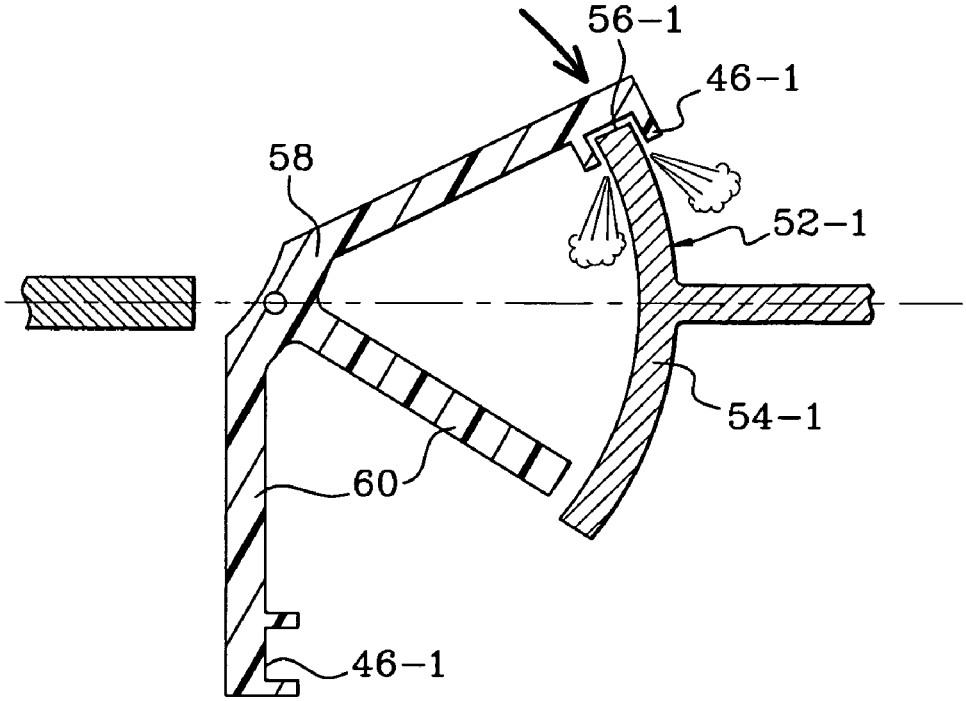
Figure 5C:
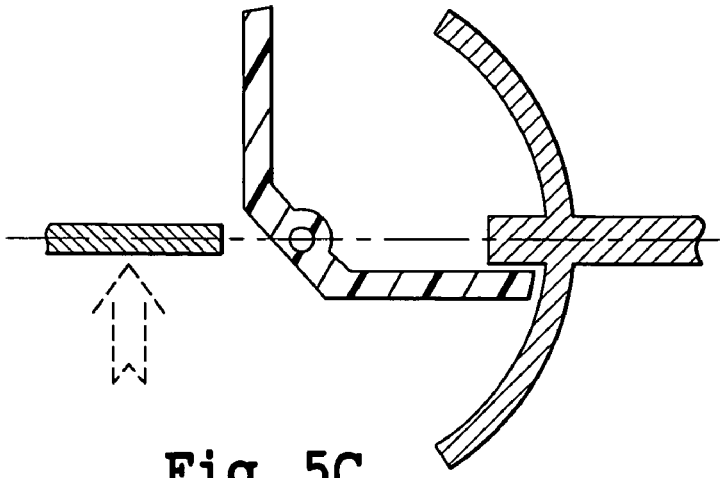
Figure 5D:
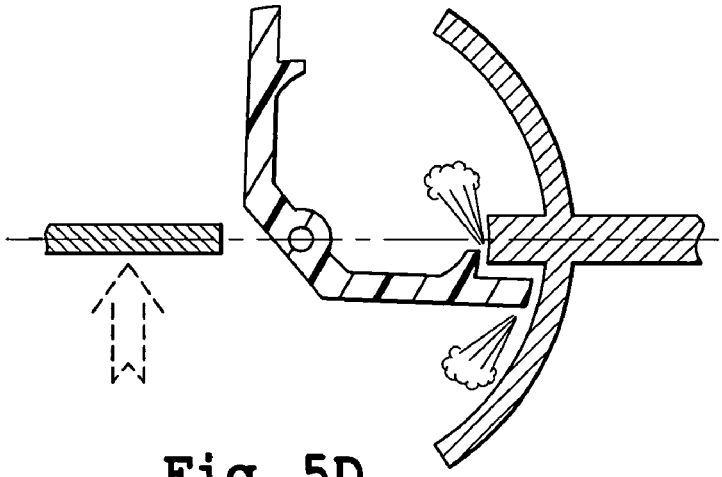

This is the object of the modifications of FIGS. 5A, 5B and 5D.

In the case of FIG. 5A, the blade carrier 32 and the flaps 44 are provided with shock absorber means 52 for the air flow. Such means take the form of a projecting wall 54, made of one piece with the blade carrier.

This wall is of a profile conjugated with the shape of each rib 46 to generate an air cushion 56 which is trapped in the volume from which escape is controlled. As shown in FIG. 5A, this air escapes but this gives a slight temporary overpressure, for an extremely short time, which nevertheless provides a shock absorbing cushion of air.

Any parasitic noise of the flap and abutment is thus suppressed or else sufficiently damped so as not to be disturbing.

The symmetrical arrangement permits shock absorbing in the two operating positions of each flap.

In FIG. 5B, there is shown a modification of the shock absorbing means in the form of a groove 46-1 coacting with the wall 52-1 projecting from the blade carrier to provide an air cushion 56-1.

In this modification, there will moreover be seen a decrease in the inertia of the flap. This flap is made from a central core 58 and radial wings 60.

Such flaps, no matter what the embodiment, are easily produced by extrusion from plastic material, with excellent precision, as is currently practiced in this field of industry.

Thus, reproducibility is ensured.

FIG. 5C shows a modification still lighter, with a core but only two radial wings. It is thus necessary to increase the height of the projecting wall so that the wings will have a certain sealing without leaving a free passage for the air.

This modification with two wings can also be provided with noise absorbing means. These latter are also recesses which generate the formation of an air cushion.

The fact of being able to provide bevels of the desired profile permits modulating the sonic spectrum of the module.

Thus, if the bevel is enlarged in line with one-third of the length of the tongue, from the heel, the air flow increases the aerodynamic driving force at this place, which promotes the production of the third harmonic, which is to say that it is at the triple frequency of the fundamental.

There can thus be substantially improved the musical quality by controlling the production precisely.

The arrangement according to the present invention permits overcoming the drawbacks of the modules of the prior art because it permits obtaining a dual single reed. Numerous advantages flow from the emplacement of such modules particularly in the production of instruments of the accordion type.

It should also be noted that, in addition to the gains as to number of pieces and weight connected with the simplification, certain other pieces can be modified.

According to the present invention, if the blade carrier must be massive in line with the securement of the heel, for the portion located at the periphery of the tongue and the flaps, the volume of necessary material can be greatly reduced by detouring it about the movable elements, namely the flaps.

Similarly, in production, the tongue 42 has been deformed to be partially integrated into the window 34. This tongue can be kept in the plane of the heel without any difficulty. It then suffices to provide bearings 62 for mounting the axles 48, on the upper surface of the blade carrier. Such bearings can be made by molding without difficulty.

The condition to be observed is the positioning of the axles 88 in the medial plane of the tongue at rest.

Figure 6:
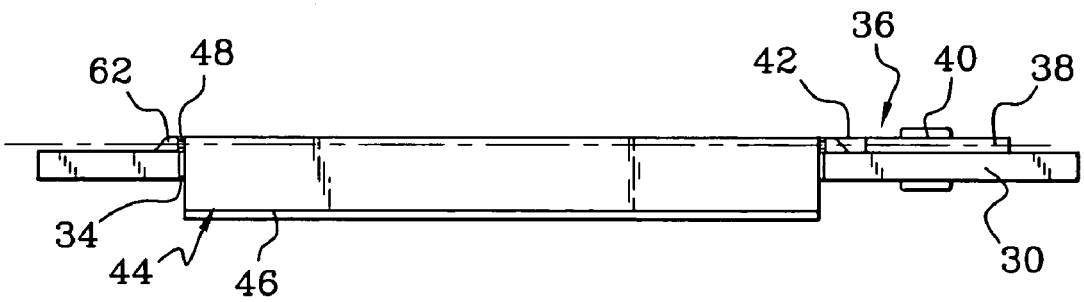

In FIG. 6 there is shown a modification of the position of the axles of the flaps above the blade carrier like the blade itself. In this modification, the heel, the tongue, the axles of the flaps are in the same plane. The bearings 62 are thus projecting. They can be made by molding with the blade carrier.

Figure 7:
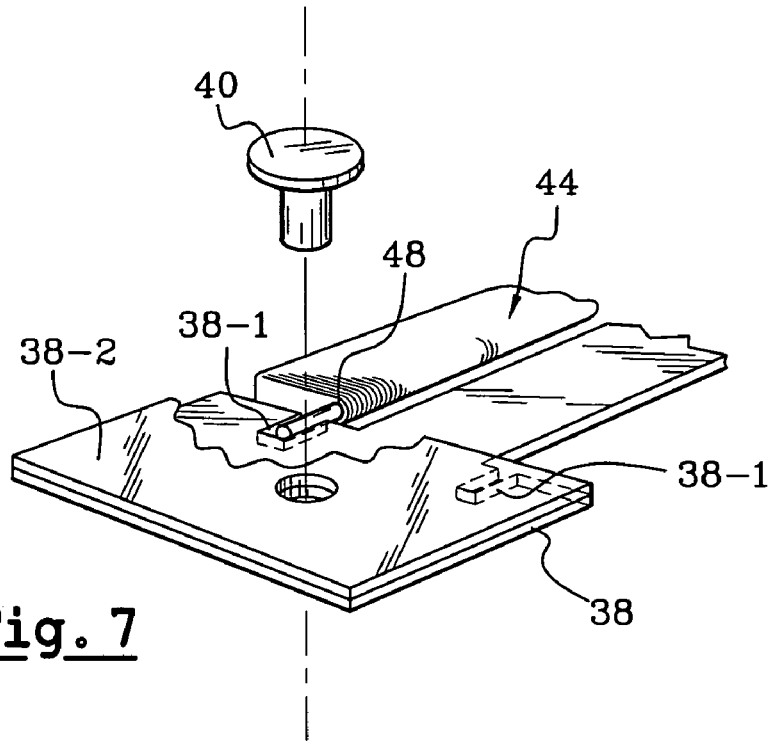

In FIG. 7 there is shown a different arrangement which provides a reed whose heel 38 is provided with two cutouts 38-1 adapted to receive the axles 48 of the flaps. A plate 38-2 is connected to the upper side of the heel, which permits providing a blind recess to receive the axles. This plate is held and maintained by the rivet 40 with the heel.

Moreover, the plate 38-2 ensures better holding of the heel, which also permits limiting the movements of the reed because these movements are not necessarily symmetrical in both directions of the air.

There will also be seen a rigidification of each flap because the axles are held in blind recesses, at the two ends. Even if the deformities are microscopic, the supplemental rigidification further improves the quality of the product.

Figure 8:
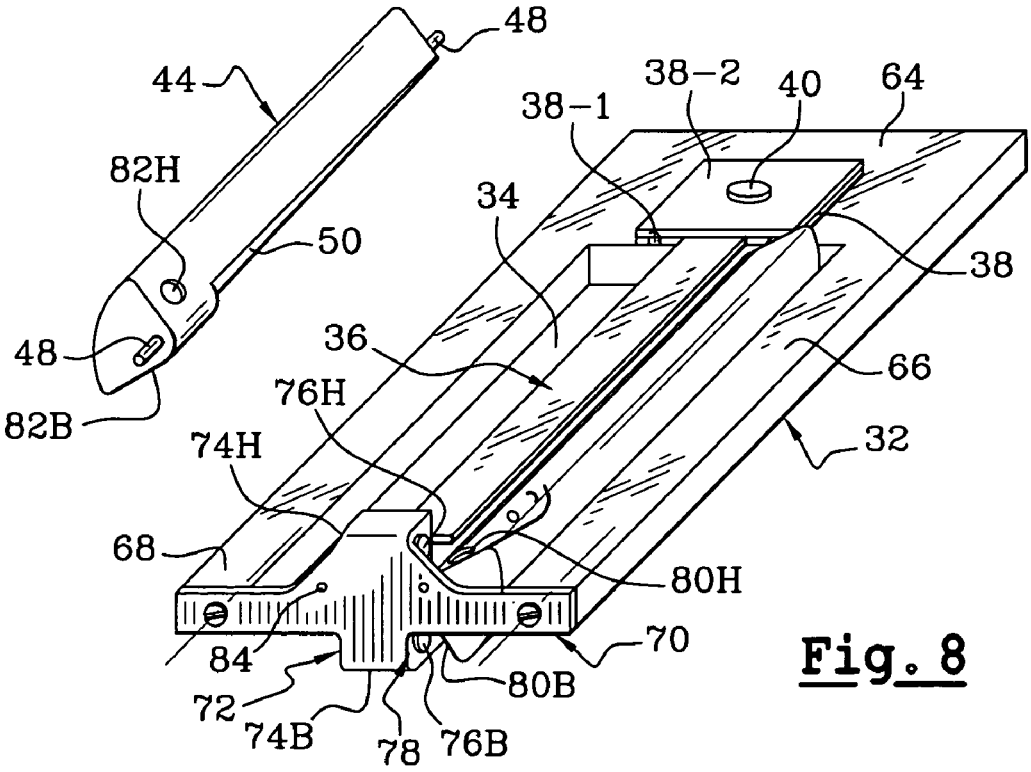

In FIG. 8, the embodiment is shown disposed arranged with a reduced number of pieces.

Its industrial nature results from several facts:

the flaps can be the same for different lengths of tongues as will be shown, only the length of the beveled portion having to be adapted, the simple shapes permit the production from a large number of choices of material, and assembly can be easily carried out.

In this FIG. 8, there is shown a blade carrier 32 of U shape with a base 64 and two branches 66 and 68 forming the three sides of the window 34.

The base 64 is adapted to receive the heel 38 of the blade 36, which heel is surmounted by a plate 38-2 as in the modification of FIG. 7.

The heel is provided with two cutouts 38-1 adapted to receive the axles 48 of the flaps.

This plate is gripped and held by the rivet 40 with the heel permitting the provision of a blind recess to receive these axles.

The ends of the branches 66 and 68 are provided to receive by screwing for example an end plate 70. This plate connects the two branches transversely and forms the fourth side of the window 34. It carries a head 72 in its medial portion, which projects perpendicularly inwardly, which is to say is in line with the end of the tongue 42 of the blade 36.

This head also projects above and below the plane of the blade carrier.

Abutments 74B and 76B; 74H and 76H, below and above, left and right, are connected to the lateral surfaces.

These abutments are shown by projecting bosses 78.

The flaps 44 have a length such that they extend beyond the length of the tongue to the end plate 70.

Each flap comprises, as in the previous embodiments, a bevel 50 provided on the contrary only along the length of the tongue 42.

The portion of the flap which is prolonged is provided with an abutment 80H and 80B; 82H and 82B. These abutments are blind recesses provided to coact by shock absorbing reception of the bosses 78. Thus, as a function of the profiles and the materials, it is possible to obtain a mechanical shock absorbing in the final phase that with priority to shock absorbing by controlled escape when the bosses penetrate the blind recesses.

The axles 48 of the flaps pivot in cutouts 38-1 in the region of the heel of the blade and in the holes 84 provided in the end plate 70.

These flaps are thus slightly prolonged by several millimeters.

The simple mechanical shapes permit production from numerous materials either with a flat, or hollow or cellular structure or by sintering hollow microballs or microtubes.

The replacement of the flaps can be carried out easily in the two cases:

either the end plate 70 and the branches 66 and 68 constitute a same and single piece and the emplacement takes place by mounting the blade 36, during its riveting, or the end plate is removable, fixed by screws, the flaps can be connected after riveting the tongue.

Numerous other practical arrangements can be envisaged without thereby departing from the scope of the present invention.

The proposed arrangement comprises flaps movable in rotation because the pivoting about an axle is actually the simplest means and gives rise to the least friction and the least wear. These are important parameters if it is desired to obtain rapid changes without inertia of the position of the flaps when the direction of the air is reversed and sufficient durability for hundreds of thousands of cycles.

If by means of suitable materials, the friction and wear could be overcome, a mounting of the flaps in translation in lieu of rotation could be suitable. The invention would thus in no way be avoided and would produce the same effects.

There is also a particularly sensitive region which is the end of the tongue because it is at this end that the moment of the acting forces is the greatest, because this is the region farthest from the point of securement, namely the rivet.

If it is desired to take action in this region, the movable elements, in this case the flaps 44, should have a shape which surrounds the tongue including its end.

The shape of the flaps is necessarily more complicated and the industrial production should take place by molding rather than extrusion.

Thus in the case of flaps made according to the preferred embodiment, the flaps can be easily produced by extrusion, in different sizes as a function of the dimensions of the tongues and hence of the types of notes, then by acting on the length of these produced elongated members.

The production of bevels can easily be industrialized, like the securement of the axles.

The arrangement according to the present invention, in addition to the advantages indicated above, can be embodied in a particular industrial construction economically and compatibly with the product to be sold.

What is claimed is:

1. A single dual reed module for an instrument of the type using two directions of air flow, comprising, for each note, a fixed single blade carrier (32) with a window (34) and a blade (36) having one end connected to said blade carrier and a vibrating portion (42) in said window, as well as at least one associated movable element (44) disposed laterally relative to said vibrating portion and adapted to have a first position for a first direction of air flow with an interstice between said movable element and an edge of said vibrating portion so that said vibrating portion vibrates to emit a note in the first direction of the air flow, and a second position for a second direction of air flow opposite to the first direction with the interstice such that said vibrating portion vibrates to emit the same note in the second direction of air flow as in the first direction.

2. The single dual reed module according to claim 1, wherein the interstice between said movable element and said vibrating portion is variable.

3. A single dual reed module for an instrument of the type using two directions of air flow, comprising, for each note, a fixed single blade carrier (32) with a window (34) and a blade (36) having one end connected to said tongue carrier and a vibrating portion (42) in said window, as well as at least one associated movable element (44) disposed laterally relative to said vibrating portion and adapted to have a first position for a first direction of air flow with an interstice between said movable element and an edge of said vibrating portion so that said vibrating portion vibrates to emit a note in the first direction of the air flow, and a second position for a second direction of air flow opposite to the first direction with the interstice such that said vibrating portion vibrates to emit the same note in the second direction of air flow as in the first direction, wherein said movable element is a movable flap mounted freely in rotation about an axle (48) disposed substantially parallel to a longitudinal axis of said vibrating portion and immediately adjacent to said vibrating portion.

4. The single dual reed module according to claim 3, wherein said movable flap is a portion of a figure of revolution, said axle of rotation being near an axis of said figure of rotation, said flap being provided with ribs (46) that stop further rotation of said movable flap for air flow in the first and second directions.

5. The single dual reed module according to claim 4, wherein said movable flap has two surfaces that will each be parallel to the air flow through the window for air flow in a respective one of the first and second directions of air flow, said movable flap having a bevel (50) provided on an edge between said two surfaces, said bevel having dimensions that vary along the longitudinal axis.

6. A single dual reed module for an instrument of the type using two directions of air flow, comprising, for each note, a fixed single blade carrier (32) with a window (34) and a blade (36) having one end connected to said tongue carrier and a vibrating portion (42) in said window, as well as at least one associated movable element (44) disposed laterally relative to said vibrating portion and adapted to have a first position for a first direction of air flow with an interstice between said movable element and an edge of said vibrating portion so that said vibrating portion vibrates to emit a note in the first direction of the air flow, and a second position for a second direction of air flow opposite to the first direction with the interstice such that said vibrating portion vibrates to emit the same note in the second direction of air flow as in the first direction, further comprising shock absorbing means (52) for abutments of said movable element relative to said blade carrier.

7. The single dual reed module according to claim 6, wherein said shock absorber means (52) comprise a portion carried by said movable element and a portion carried by said blade carrier that together generate an air cushion (56).

8. The single dual reed module according to claim 6, wherein said shock absorber means comprise an end plate (70) provided with a head (72) projecting inwardly toward a free end of said vibrating portion.

9. The single dual reed module according to claim 8, wherein said head (72) has projecting bosses (78), and said movable element has blind recesses provided to coact by shock absorbing nesting with said bosses (78).

10. The single dual reed module according to claim 1, wherein said one end of said blade is fixed to said blade carrier by a rivet.

11. The single dual reed module according to claim 1, further comprising a second said movable element (44) disposed laterally relative to said vibrating portion on a side of said vibrating portion opposite said at least one movable element.

12. The single dual reed module according to claim 3, wherein said axle is disposed in a medial plane of said vibrating portion at rest.

* * * * *